US010697273B2

(12) United States Patent
Zhang et al.

(10) Patent No.: US 10,697,273 B2
(45) Date of Patent: Jun. 30, 2020

(54) METHOD FOR SCALE TREATMENT OPTIMIZATION

(71) Applicant: NextSteam Sensor, LLC, Oklahoma City, OK (US)

(72) Inventors: Jianmin Zhang, Edmond, OK (US); Michael Salerno, Edmond, OK (US); Sam Stroder, Edmond, OK (US); Qiliang Wang, Edmond, OK (US)

(73) Assignee: NextStream Sensor, LLC, Oklahoma City, OK (US)

( * ) Notice: Subject to any disclaimer, the term of this patent is extended or adjusted under 35 U.S.C. 154(b) by 121 days.

(21) Appl. No.: 15/935,916

(22) Filed: Mar. 26, 2018

(65) Prior Publication Data

US 2019/0292881 A1 Sep. 26, 2019

(51) Int. Cl.

| | |
|---|---|
| ***E21B 37/06*** | (2006.01) |
| ***E21B 47/06*** | (2012.01) |
| ***E21B 47/10*** | (2012.01) |
| ***E21B 49/08*** | (2006.01) |

(52) U.S. Cl.

CPC ..... *E21B 37/06* (2013.01); *E21B 47/06* (2013.01); *E21B 47/065* (2013.01); *E21B 47/10* (2013.01); *E21B 49/08* (2013.01)

(58) Field of Classification Search

CPC ..... E21B 37/06; E21B 47/06; E21B 47/065; E21B 47/10; E21B 49/08

See application file for complete search history.

(56) References Cited

U.S. PATENT DOCUMENTS

| | | | |
|---|---|---|---|
| 2,729,976 | A | 1/1956 | Laub |
| 4,354,553 | A | 10/1982 | Hensley |
| 5,163,321 | A | 11/1992 | Perales |
| 6,237,701 | B1 | 5/2001 | Kolle et al. |
| 6,375,829 | B1 | 4/2002 | Shevchenko et al. |
| 6,973,972 | B2 | 12/2005 | Aronstam |
| 7,407,589 | B2 | 8/2008 | Holland |
| 2003/0024814 | A1 | 2/2003 | Stetter |
| 2006/0254766 | A1 | 11/2006 | Richard et al. |
| 2007/0278007 | A1 | 12/2007 | Krueger et al. |
| 2008/0067129 | A1 | 3/2008 | Juenke et al. |
| 2010/0294662 | A1 | 11/2010 | Zheng et al. |
| 2010/0300684 | A1 | 12/2010 | Kotsonis et al. |
| 2011/0046467 | A1 | 2/2011 | Simpson et al. |

(Continued)

FOREIGN PATENT DOCUMENTS

| | | | |
|---|---|---|---|
| CN | 203215190 | U | 9/2013 |
| WO | 2017052529 | A1 | 3/2017 |

OTHER PUBLICATIONS

International Search Report and Written Opinion dated May 30, 2019, issued in PCT/US2019/023122.

(Continued)

*Primary Examiner* — Yong-Suk Ro

(74) *Attorney, Agent, or Firm* — McAfee & Taft

(57) ABSTRACT

A system and method for preventing scale in a well. The system includes a conduit providing fluid communication between a first location and a second location and a sensor at the second location configured to measure scale deposition in the fluid and a value of a fluid parameter. A scale deposition at the first location is determined from the scale deposition at the second location and the fluid parameter at the second location. A scale inhibitor is injected at the first location based on the determined scale deposition at the first location.

12 Claims, 2 Drawing Sheets

(56) References Cited

U.S. PATENT DOCUMENTS

| | | | |
|---|---|---|---|
| 2011/0230741 | A1 | 9/2011 | Liang et al. |
| 2012/0187000 | A1 | 7/2012 | Kahn et al. |
| 2013/0048569 | A1 | 2/2013 | Ogut et al. |
| 2015/0029496 | A1 | 1/2015 | Duggirala et al. |
| 2016/0024915 | A1 | 1/2016 | Duchene et al. |
| 2016/0289536 | A1 | 10/2016 | Koskan et al. |

OTHER PUBLICATIONS

International Search Report and Written Opinion dated Jun. 6, 2019, issued in PCT/US2019/023298.
International Search Report and Written Opinion dated Jun. 6, 2019, issued in PCT/US2019/023300.
Images of prior art systems.

METHOD FOR SCALE TREATMENT OPTIMIZATION

BACKGROUND

In a production process at a wellbore, formation fluid containing hydrocarbons and water is drawn from a downhole formation into a production tubing and lifted uphole to a surface location. Inorganic scale-forming constituents such as calcium, magnesium, etc. are often present in the water and hydrocarbons. These scales tend to precipitate at various locations on the tubing, eventually limiting production from the wellbore. In order to prevent the formation of the scale, scale inhibitor is pumped into the fluid at a downhole location at a level determined from measurements of water sample chemistry and operation parameters of a production process.

Due to technical difficulties, it is impractical to place a scale sensor in a production well. However, scale measurements at a surface location do not take into account differences between the environmental conditions downhole vs. at a surface location that have an effect on the risk of scale precipitation. Therefore, there is a need to be able to determine scale parameters downhole that account for differences in environmental conditions between surface and downhole locations.

BRIEF DESCRIPTION

In a method of preventing scale in a well includes receiving a fluid at a second location in fluid communication with a first location; measuring, via a sensor at the second location, scale deposition in the fluid and a value of a fluid parameter; determining, from the scale deposition at the second location and the fluid parameter at the second location, scale deposition at the first location; and injecting a scale inhibitor at the first location based on the determined scale deposition at the first location.

A system for scale prevention includes a conduit for fluid communication between a first location and a second location; a sensor at the second location configured to measure scale deposition in the fluid and a value of a fluid parameter; and a processor configured to: determine, from the scale deposition at the second location and the value of the fluid parameter at the second location, scale deposition at the first location, and inject a scale inhibitor at the first location based on the determined scale deposition.

BRIEF DESCRIPTION OF THE DRAWINGS

The following descriptions should not be considered limiting in any way. With reference to the accompanying drawings, like elements are numbered alike.

DETAILED DESCRIPTION

A detailed description of one or more embodiments of the disclosed apparatus and method are presented herein by way of exemplification and not limitation with reference to the Figures.

Figure 1:
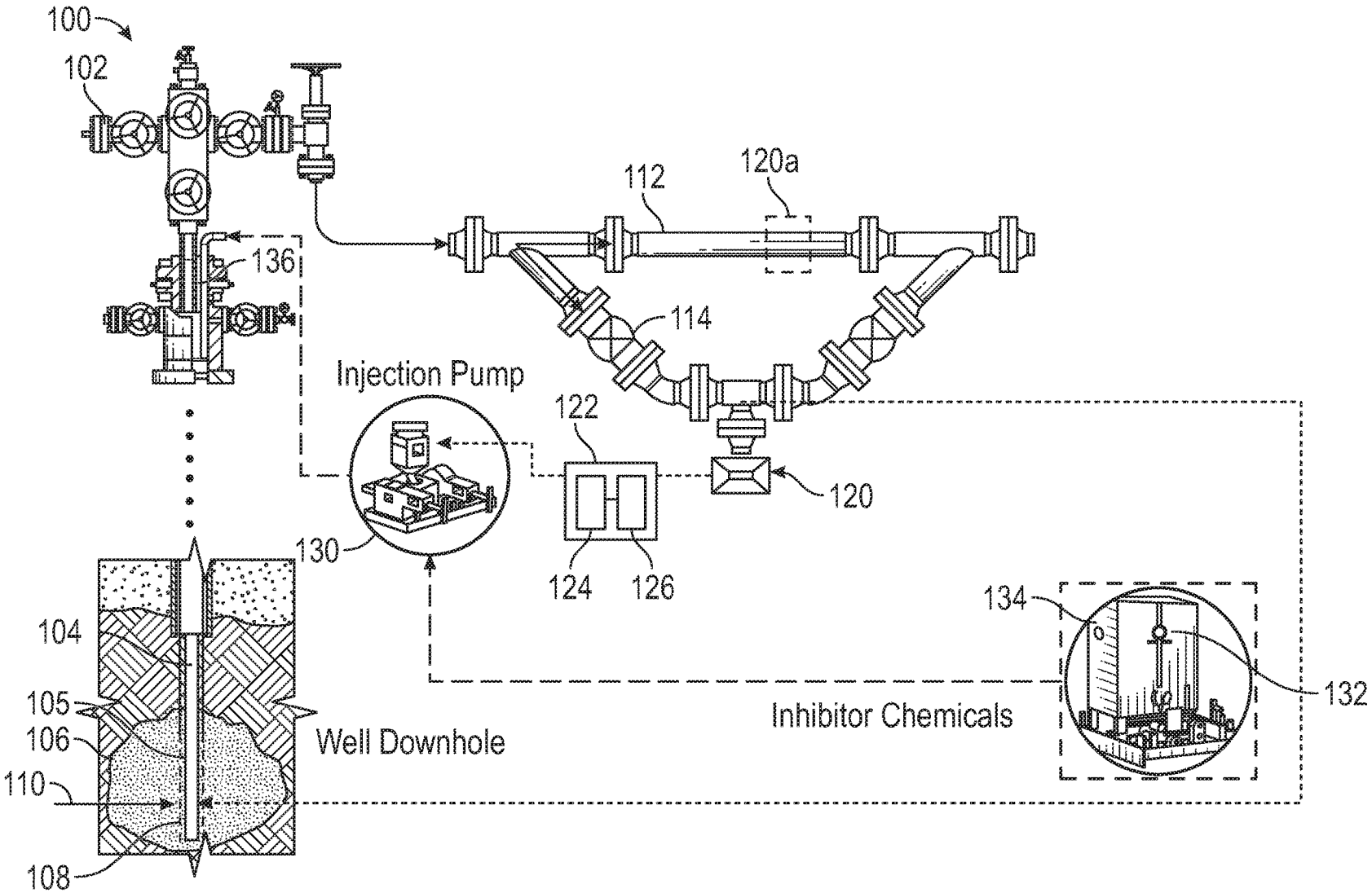
FIG. 1 shows a well production system 100 in an illustrative embodiment.

FIG. 1 shows a well production system 100 in an illustrative embodiment. The production system 100 includes a wellhead 102 at a surface location and a production tubing 104 that extends through a well or wellbore 105 from the wellhead 102 to a selected location within a formation 106. Formation fluid 110 is drawn into the production tubing 104 through perforations 108 and is transported uphole through the production tubing 104. From the wellhead 102, the fluid 110 flows through various pipes, tubular, or conduits and is processed. FIG. 1 shows an illustrative conduit 112 through which the fluid 110 flows. A bypass conduit 114 branches off of the conduit 112 in order to divert a sample of the fluid 110 for measurement purposes. A sensor 120 in the bypass conduit 114 detects the presence of scale in the fluid 110. The sensor 120 shown in FIG. 1 can refer to a scale sensor or a cluster of sensors that includes the scale sensor and additional sensors that measure additional fluid parameters such as fluid temperature, fluid pressure, water cut of the fluid, pH of the fluid, salt content of the fluid, flow rate, surface roughness, etc. These fluid parameters can be used along with the scale measurement to determine scale production in the wellbore 105 using the methods disclosed herein. Although shown as located in the bypass conduit 114, in alternate embodiments, the sensor (labelled 120*a*) can be included in the conduit 112, thereby removing the need for a bypass conduit 114.

Sensor 120 is in communication with a control unit 122 and sends the scale measurements and at least one of the measurements of the additional fluid parameter to the control unit 122. The control unit 122 determines the likelihood of scale precipitation in the wellbore from the scale measurements and the measured additional fluid parameters, as discussed below with respect to FIG. 2. The control unit 122 includes a processor 124 and a memory storage device 126 that stores therein various program that when accessed by the processor 124, enable the processor 124 to determine a scale parameter such as scale volume, scale concentration, or scale production at a downhole location from sensor measurements and fluid parameter measurements obtained by the sensor 120 and/or associated fluid parameter sensors.

The control unit 122 is in communication with an injection unit 130 that can be an injection pump. The injection unit 130 pumps a scale inhibitor 132 from a storage tank 134 to the wellbore 105 via a capillary tube 136 that extends along the production tubing 102, or can be injected at the surface into the tubing casing annulus where it is effectively carried down the surface by gas lift injection gas or even gravity. The control unit 122 controls the pumping rate of injection unit 130 to deliver an amount of scale inhibitor 132 that is determined by the processor 124 based on a calculated amount of downhole scale volume determined by the processor 124. The injection location of the scale inhibitor can be at the location at which the fluid 110 enters the production tubing 104. In other embodiment, the scale inhibitor can be injected into the formation surrounding the entry point of the production tubing 104 via the temporary injection at the surface of a significant volume of scale inhibitor displaced down the wellbore and into the formation by a large volume of carrying fluid, in what is often referred to as a "scale squeeze" operation.

Figure 2:
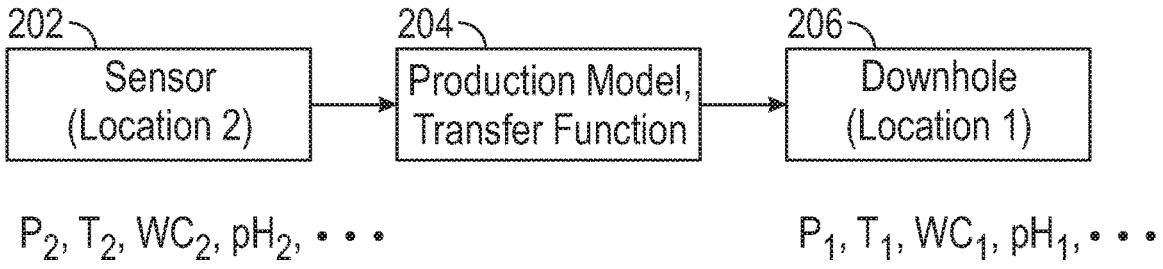
FIG. 2 illustrates a method for determining an amount of scale inhibitor to inject into the wellbore from sensors measurements.

FIG. 2 illustrates a method for determining an amount of scale inhibitor to inject into the wellbore from sensor(s) measurements. The sensor 120 is located at an uphole or surface location (also referred to herein as "a second location") and obtains scale measurements as well as measurements of fluid parameter at the second location, such as fluid temperature ($T_2$) at the second location, fluid pressure ($P_2$)

at the second location, water cut ($WC_2$) at the second location, fluid pH ($pH_2$) at the second location, salt content of the fluid at the second location, flow rate at the second location, surface roughness, etc. The conduit (112, FIG. 1) provides fluid communication between the first location and the second location.

The values of the scale measurements and of the fluid parameter at the second location are provided to a model that is at the processor (124, FIG. 1). The model can include one or more transfer functions that calculate or determine a parameter at a first location from a parameter at a second location and a physical relation between the locations. For example, the physical parameters of the production system and or conduits can be used to relate a temperature measurement at the second location with the temperature at the first location. The model incorporates of physical factors affecting scale deposition in the production system in order to calculate the scale volume at the first location.

Using the model, the processor 124 calculates an environmental condition at the first location (e.g., at a downhole location at which fluid flows from the formation in the production tubing). In other words, the model is used to calculate such parameters as scaling risk, based on fluid temperature ($T_1$) at the first location, fluid pressure ($P_1$) at the first location, water cut ($WC_1$) at the first location, fluid pH ($pH_1$) at the first location, salt content of the fluid at the first location, flow rate at the first location, surface roughness, etc. The calculated values of these parameters at the first location can be used (along with the scale measurements obtained at the second location) to determine an amount or concentration of scale in the fluid at the first location. From the calculated amount of scale at the first location, the processor 124 can determine an amount of scale inhibitor to pump to the first location and control the injection unit 130 accordingly.

Returning to FIG. 1, the control unit 122 performs a closed-loop process in which the sensor 120 and control unit 122 are continuously monitoring the scale measurements and fluid parameter values during the production process. The control unit 122 can therefore provide continuous adjustments to the amount of scale inhibitor that is being delivered downhole, thereby optimizing scale inhibitor delivery and reducing the possibility of over-dosing or under-dosing the wellbore formation.

In an alternate embodiment, the control unit 122 can signal the need for scale inhibitor injection downhole via a squeeze operation. In a squeeze operation, a selected amount of scale inhibitor is injected downhole that is estimated to reduce or mitigate the presence of scale in formation fluid for a selected amount time, which can be several months, and a subsequent injection occurs only when scale levels reach a selected amount. The scale inhibitor is injected into the formation at the downhole location to allow the scale inhibitor to reduce scale from forming and precipitating at the downhole location. The amount of scale inhibitor remaining downhole is reflected in scale measurements. The control unit 122 therefore monitors the scale measurements and fluid parameters to predict this scale formation at the downhole location and, when this amount is considered too high, signals the need for a next scale inhibitor squeeze operation.

Figure 3:
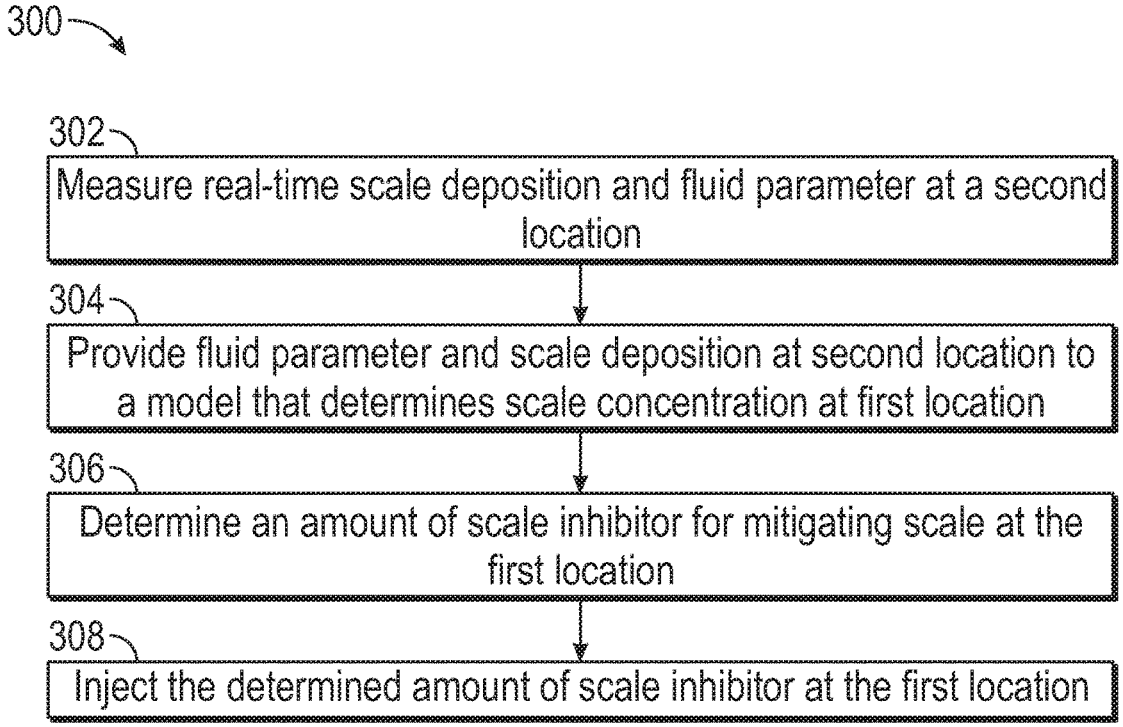
FIG. 3 shows a flowchart illustrating a scale inhibitor injection process according to an embodiment.

FIG. 3 shows a flowchart 300 illustrating a scale inhibitor injection process according to an embodiment. In box 302, real-time scale deposition and additional fluid parameter measurements are obtained at a second location, generally in a fluid conduit at a surface location. In box 304, the measurements of the additional fluid parameters at the second location and the measurement of real-time scale deposition at the second location are provided to a model that includes transfer functions that determine a value of the scale deposition real-time at the first location. Other parameters used in the model can be obtained from process instrumentation at locations other than the first location and the second location. In box 306, an amount of scale inhibitor is determined for the determined value of the scale parameter in order to mitigate at the first location. In box 308, the determined amount of scale inhibitor is injected at the first location.

In another embodiment, the system is used with an injection well or a disposal well in which fluid is being pumped to a downhole location within a formation. In this embodiment, measurements of scale and the fluid parameter are made a surface location and the expected scale is determined or calculated for the downhole location into which the fluid is being pumped. The control unit 122 can then control the injection unit 130 to deliver an appropriate amount of scale inhibitor to this downhole location.

Set forth below are some embodiments of the foregoing disclosure:

Embodiment 1

A method of preventing scale in a well, comprising: receiving a fluid at a second location in fluid communication with a first location; measuring, via a sensor at the second location, scale deposition in the fluid and a value of a fluid parameter; determining, from the scale deposition at the second location and the fluid parameter at the second location, scale deposition at the first location; and injecting a scale inhibitor at the first location based on the determined scale deposition at the first location.

Embodiment 2

The method as in any prior embodiment, wherein the parameter includes at least one of: (i) temperature at or near the second location; (ii) pressure at or near the second location; (iii) water cut at or near the second location; (iv) a pH at or near the second location; (v) a salt content at or near the second location; (vi) a flow rate; and a surface roughness at or near the second location.

Embodiment 3

The method as in any prior embodiment, further comprising determining the scale deposition at the first location from the scale deposition at the second location, the value of the fluid parameter at or near the second location and a transfer model.

Embodiment 4

The method as in any prior embodiment, further comprising determining the value of the fluid parameter at the first location from the value of the fluid parameter at the second location, and determining the amount of scale at the first location from the value of the fluid parameter at the first location.

Embodiment 5

The method as in any prior embodiment, further comprising injecting the scale inhibitor via one of: (i) a continuous process; and (ii) a squeeze process.

Embodiment 6

The method as in any prior embodiment, wherein the further comprising flowing the fluid in one of: (i) from the first location to the second location via a conduit and (ii) from the second location to the first location via the conduit.

Embodiment 7

The method as in any prior embodiment, further comprising measuring the scale deposition and the value of the fluid parameter at a sensor that is one of: (i) coupled to the conduit; and (ii) coupled to a bypass line of the conduit.

Embodiment 8

The method as in any prior embodiment, wherein the first location is in the well and the second location is outside of the well.

Embodiment 9

A system for scale prevention, comprising: a conduit for fluid communication between a first location and a second location; a sensor at the second location configured to measure scale deposition in the fluid and a value of a fluid parameter; and a processor configured to: determine, from the scale deposition at the second location and the value of the fluid parameter at the second location, scale deposition at the first location, and inject a scale inhibitor at the first location based on the determined scale deposition.

Embodiment 10

The system as in any prior embodiment, wherein the fluid parameter includes at least one of: (i) temperature at or near the second location; (ii) pressure at or near the second location; (iii) water cut at or near the second location; (iv) a pH at or near the second location; (v) a salt content at or near the second location; (vi) a flow rate; and a surface roughness or near the second location.

Embodiment 11

The system as in any prior embodiment, wherein the processor is further configured to determine the scale deposition at the first location from the scale deposition at the second location, the value of the fluid parameter at the second location and a transfer model.

Embodiment 12

The system as in any prior embodiment, further comprising an injection unit, wherein the processor controls the injection unit to inject the scale inhibitor via a continuous process.

Embodiment 13

The system as in any prior embodiment, further comprising a conduit for flowing the fluid in one of: (i) from the first location to the second location and (ii) from the second location to the first location.

Embodiment 14

The system as in any prior embodiment, wherein the sensor is one of: (i) coupled to the conduit; and (ii) coupled to a bypass line of the conduit.

Embodiment 15

The system as in any prior embodiment, wherein the first location is in the well and the second location is outside of the well.

The use of the terms "a" and "an" and "the" and similar referents in the context of describing the invention (especially in the context of the following claims) are to be construed to cover both the singular and the plural, unless otherwise indicated herein or clearly contradicted by context. Further, it should be noted that the terms "first," "second," and the like herein do not denote any order, quantity, or importance, but rather are used to distinguish one element from another. The modifier "about" used in connection with a quantity is inclusive of the stated value and has the meaning dictated by the context (e.g., it includes the degree of error associated with measurement of the particular quantity).

The teachings of the present disclosure may be used in a variety of well operations. These operations may involve using one or more treatment agents to treat a formation, the fluids resident in a formation, a wellbore, and/or equipment in the wellbore, such as production tubing. The treatment agents may be in the form of liquids, gases, solids, semi-solids, and mixtures thereof. Illustrative treatment agents include, but are not limited to, fracturing fluids, acids, steam, water, brine, anti-corrosion agents, cement, permeability modifiers, drilling muds, emulsifiers, demulsifiers, tracers, flow improvers etc. Illustrative well operations include, but are not limited to, hydraulic fracturing, stimulation, tracer injection, cleaning, acidizing, steam injection, water flooding, cementing, etc.

While the invention has been described with reference to an exemplary embodiment or embodiments, it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiment disclosed as the best mode contemplated for carrying out this invention, but that the invention will include all embodiments falling within the scope of the claims. Also, in the drawings and the description, there have been disclosed exemplary embodiments of the invention and, although specific terms may have been employed, they are unless otherwise stated used in a generic and descriptive sense only and not for purposes of limitation, the scope of the invention therefore not being so limited.

What is claimed is:

1. A method of preventing scale in a well, comprising:

receiving a fluid at a second location in fluid communication with a first location, the first location being in the well;

measuring, via a sensor at the second location, scale deposition in the fluid and a value of a fluid parameter as the fluid is flowing through a conduit;

determining, from the scale deposition at the second location and the fluid parameter at the second location, scale deposition at the first location; and injecting a scale inhibitor at the first location based on the determined scale deposition at the first location.

2. The method of claim 1, wherein the parameter includes at least one of: (i) temperature at or near the second location; (ii) pressure at or near the second location; (iii) water cut at or near the second location; (iv) a pH at or near the second location; (v) a salt content at or near the second location; (vi) a flow rate; and a surface roughness at or near the second location.

3. The method of claim 1, further comprising determining the scale deposition at the first location from the scale deposition at the second location, the value of the fluid parameter at or near the second location and a transfer model.

4. The method of claim 1, further comprising determining the value of the fluid parameter at the first location from the value of the fluid parameter at the second location, and determining the amount of scale at the first location from the value of the fluid parameter at the first location.

5. The method of claim 1, further comprising injecting the scale inhibitor via one of: (i) a continuous process; and (ii) a squeeze process.

6. The method of claim 1, the sensor being one of: (i) coupled to the conduit; and (ii) coupled to a bypass line of the conduit.

7. A system for scale prevention, comprising:

a conduit for fluid communication between a first location in a well and a second location outside the well;

a sensor at the second location configured to measure scale deposition in the fluid and a value of a fluid parameter in the fluid as the fluid is flowing through the conduit; and a processor configured to:

determine, from the scale deposition at the second location and the value of the fluid parameter at the second location, scale deposition at the first location, and inject a scale inhibitor at the first location based on the determined scale deposition.

8. The system of claim 7, wherein the fluid parameter includes at least one of: (i) temperature at or near the second location; (ii) pressure at or near the second location; (iii) water cut at or near the second location; (iv) a pH at or near the second location; (v) a salt content at or near the second location; (vi) a flow rate; and a surface roughness or near the second location.

9. The system of claim 7, wherein the processor is further configured to determine the scale deposition at the first location from the scale deposition at the second location, the value of the fluid parameter at the second location and a transfer model.

10. The system of claim 7, further comprising an injection unit, wherein the processor controls the injection unit to inject the scale inhibitor via a continuous process.

11. The system of claim 7, wherein the sensor is one of: (i) coupled to the conduit; and (ii) coupled to a bypass line of the conduit.

12. The system of claim 7, wherein the first location is in the well and the second location is outside of the well.

* * * * *